United States Patent [19]

Strawson et al.

[11] 3,990,584

[45] Nov. 9, 1976

[54] ELECTRICAL SAFETY CONTROL DEVICE FOR A VARIABLE RADIUS CRANE

[75] Inventors: Kenneth Horace Strawson; Keith Thomas Salvin; David Silvester Lane, all of Sheffield, England

[73] Assignees: Strawson Hydraulics (Consultants) Limited; Wharncliffe Fabricators & Engineers Limited, both of Sheffield, England

[22] Filed: June 3, 1974

[21] Appl. No.: 476,146

[52] U.S. Cl. ..... 212/39 MS; 340/267 C; 212/55

[51] Int. Cl.[2] ..... B66C 13/48

[58] Field of Search ..... 212/39 R, 39 MS, 39 A, 212/37, 86, 132, 55; 340/267 R, 267 C

[56] References Cited

UNITED STATES PATENTS

| | | | |
|---|---|---|---|
| 2,030,529 | 2/1936 | Nash | 212/39 MS |
| 2,346,066 | 4/1944 | Conrad | 212/39 MS |
| 3,200,963 | 8/1965 | Vermes | 212/39 MS |
| 3,638,211 | 1/1972 | Sanchez | 212/39 MS X |
| 3,767,061 | 10/1973 | Tay et al. | 212/39 MS X |
| 3,828,339 | 8/1974 | Schedrovitsky et al. | 212/39 MS |
| 3,834,550 | 9/1974 | Eiler | 212/39 MS |
| 3,841,493 | 10/1974 | Jackson et al. | 212/39 MS |

FOREIGN PATENTS OR APPLICATIONS

| | | | |
|---|---|---|---|
| 1,065,152 | 9/1959 | Germany | 212/39 R |

*Primary Examiner*—Robert J. Spar
*Assistant Examiner*—R. B. Johnson
*Attorney, Agent, or Firm*—Young & Thompson

[57] ABSTRACT

A safety device for a crane including means for continuously comparing an actual load carried by a lifting hook with an indicated maximum safe working load for that particular working radius.

1 Claim, 13 Drawing Figures

ELECTRICAL SAFETY CONTROL DEVICE FOR A VARIABLE RADIUS CRANE

The invention relates to safety devices for cranes and to cranes provided with such devices, and has for its object to provide an improvement therein. The invention is particularly useful for cranes of the kind having extensible booms but may also be used for cranes having booms of fixed length and also tower cranes.

According to one aspect of the invention, a safety device for a jib crane of variable working radius from a free end of the jib of which depends a lifting hook includes means for sensing the working radius of the lifting hook; means for sensing the magnitude of a load carried by the lifting hook; and means for continuously relating an electrical signal proportional to said load to an electrical signal proportional to the maximum allowable safe working load at that particular working radius, the last mentioned means including a plurality of resistive devices or inductive devices or electrostatic devices usable selectively and capable of producing varying electrical signals continuously throughout the operation of the crane and having parts formed in accordance with the maximum allowable safe working loads at varying working radii under different working conditions, and also including means for moving parts of said resistive, inductive or electrostatic devices, through distances proportional to the indicated working radius of the lifting hook so that there is continuously produced the electrical signal proportional to the maximum allowable safe working load at that particular working radius.

The means for comparing the indicated instantaneous maximum allowable safe working load with the indicated actual load carried by the lifting hook may be constituted by means for comparing the relative strengths of the two electrical signals indicative of these two values. The means for sensing the working radius of the boom will preferably be constituted by means responsive to changes in the elevation of the jib or boom where this is luffable and means responsive to changes in the length of the boom where this is telescopic. The means responsive to changes in the elevation of the jib or boom will preferably include a mercury switch with electric terminals at each end the closure of which, in response to a movement of said jib or boom, causes forward or reverse rotation of a servomotor, as required, to return the switch to, or maintain it in a true horizontal position and simultaneously drive an electric proportioning device so that the latter produced an electric signal proportional to the elevation of the jib or boom. However, such means could quite well include other kinds of switch, for example a switch operated by a pendulum device. The means responsive to changes in the length of the boom on the other hand will preferably include a cable reeling drum mounted for rotation on a fixed part of the crane or on an innermost section of the crane boom, a length of cable being wound upon the drum and extending to an outermost end of the extensible boom, means being provided for acting upon said drum in the opposite sense to said cable and arranged to take up slack in said cable as the boom is shortened. The last mentioned means will preferably be constituted by a spring (but could conceivably be constituted by a permanently stalled D.C. electric motor which would maintain a constant tension in the cable by its developed torque). The arrangement will be such that any linear extension or retraction of the boom will result in rotation of the cable reeling drum and this rotation will preferably be transmitted by way of reduction gearing to an electrical proportioning device which thus produces an electric signal proportional to the effective length of the boom. (Various other mechanisms may however be employed to produce an electric signal proportional to the effective length of the boom). This latter electric signal will preferably be fed into an electric circuit to which is also fed the electric signal proportional to the elevation of the boom, the circuit being such that a single electric output signal therefrom is proportional to the working radius of the boom.

The means for sensing the load carried by the boom is preferably constituted by an electronic rope dynamometer including an electronic load cell acting against the load-carrying rope and deflected in proportion to the load carried by the rope.

The safety device preferably also includes an indicator unit for indicating the load carried by the boom. It will preferably also indicate the instantaneous maximum allowable safe working load at any particular working radius and in any particular working condition, and/or the working radius of the boom. The scales will preferably be graduated on a common plate and may be graduated around concentric circles, in which case a pointer for indicating the working radius of the boom may extend radially inwards from an arm movable around the periphery of the plate and a pointer for indicating the load carried by the boom may extend radially outwards from a central shaft. On the other hand however, the indicator unit may be provided with straight scales having edge mounted pointers or indeed could even be provided with digital read out mechanisms.

According to a further aspect of the invention, there is provided a crane with an extensible boom and with a safety device including means for sensing the working radius of the boom, means for sensing the load carried by the boom, and means for relating said load to the maximum allowable safe working load at that particular working radius.

In order that the invention may be fully understood and readily carried into effect, the same will now be described, by way of example only, with reference to the accompanying drawings, of which:

Figure 3:
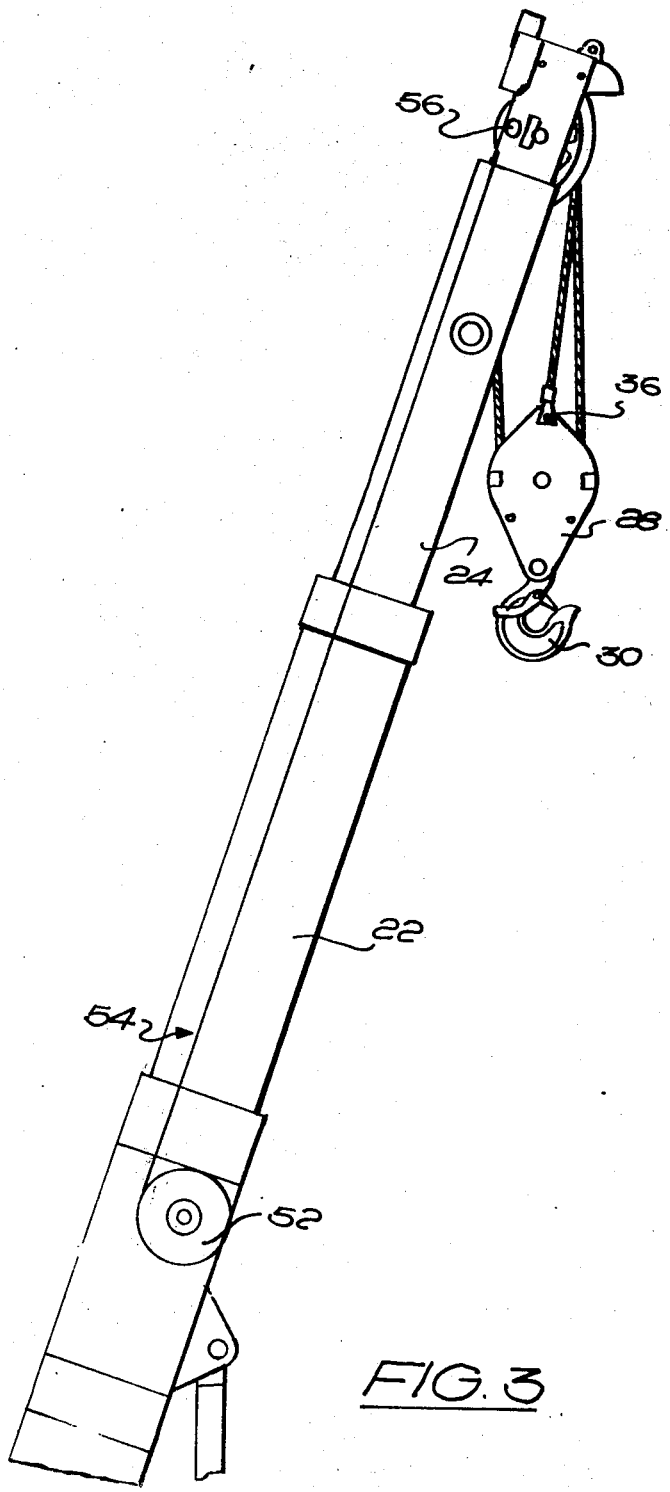
Figure 4:
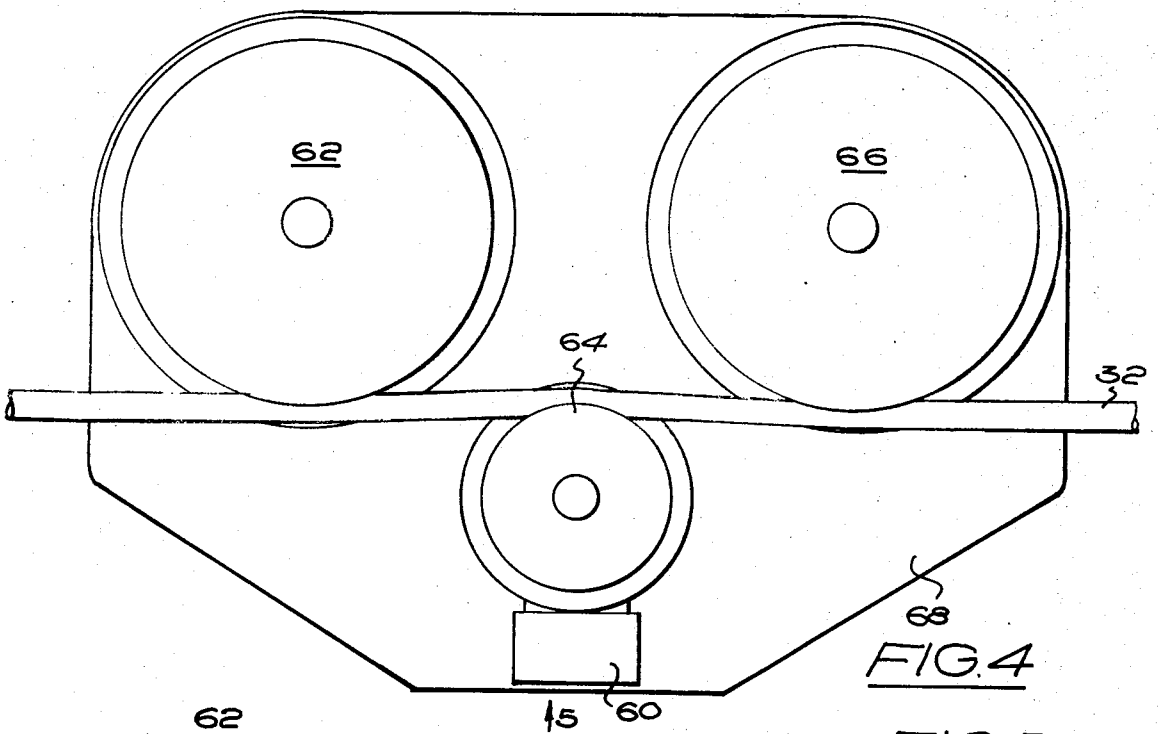
Figure 5:
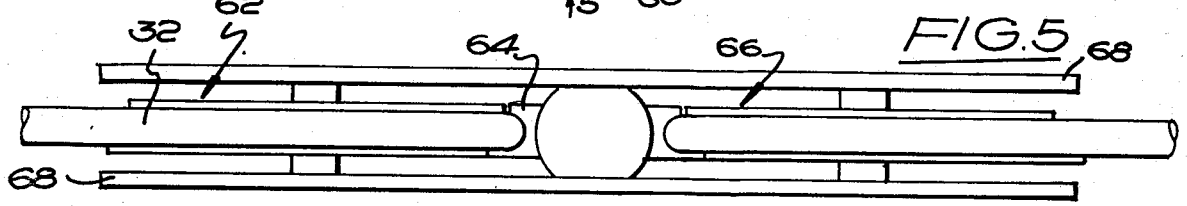
Figure 6:
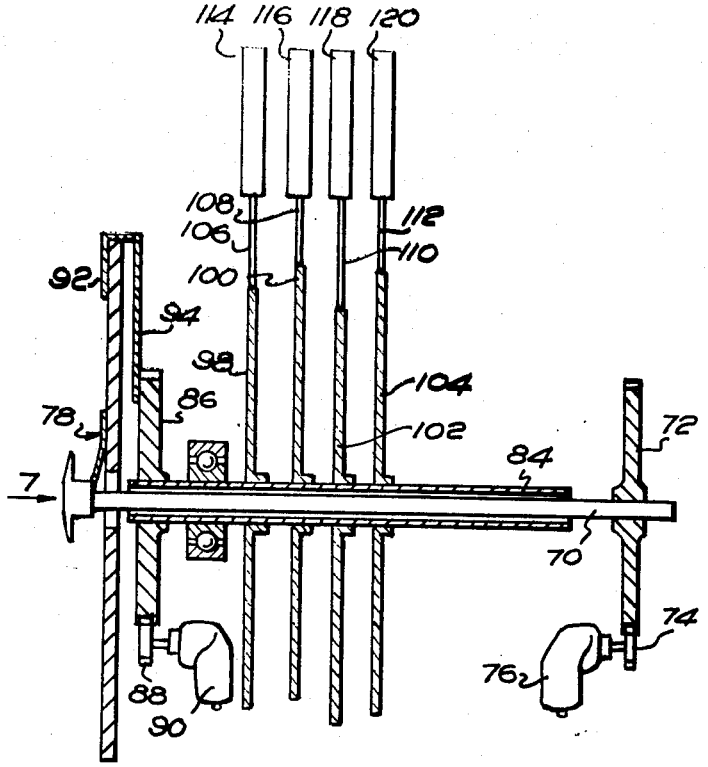
Figure 7:
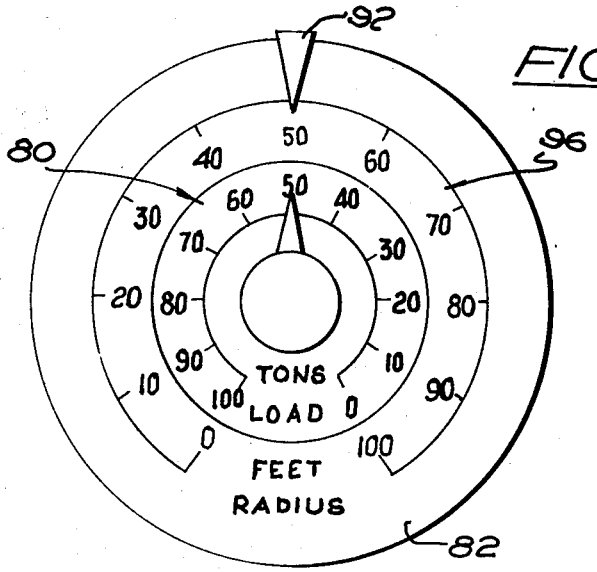
Figure 7A:
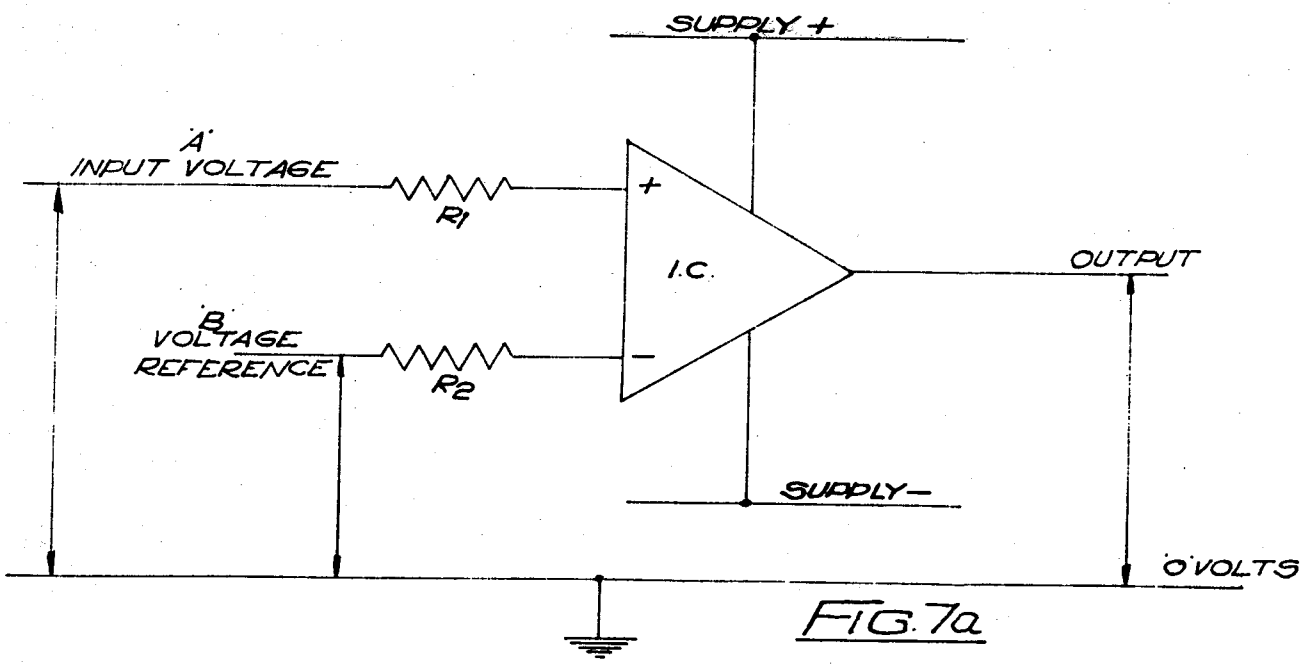

FIG. 3 is a view of an extensible jib forming part of the crane and to which a part of the safety device has been fixed, FIG. 4 is a view which will presently be referred to as a rope dynamometer forming part of the safety device, FIG. 5 is a view in the direction of arrow 5 in FIG. 4, FIG. 6 is a view of further-mechanism forming part of the safety device, FIG. 7 is a view in the direction of arrow 7 in FIG. 6, FIG. 7*a* is a diagrammatic view of a so-called comparator circuit, and FIGS. 8 to 12 are views of possible modifications which may be made.

Figure 1:
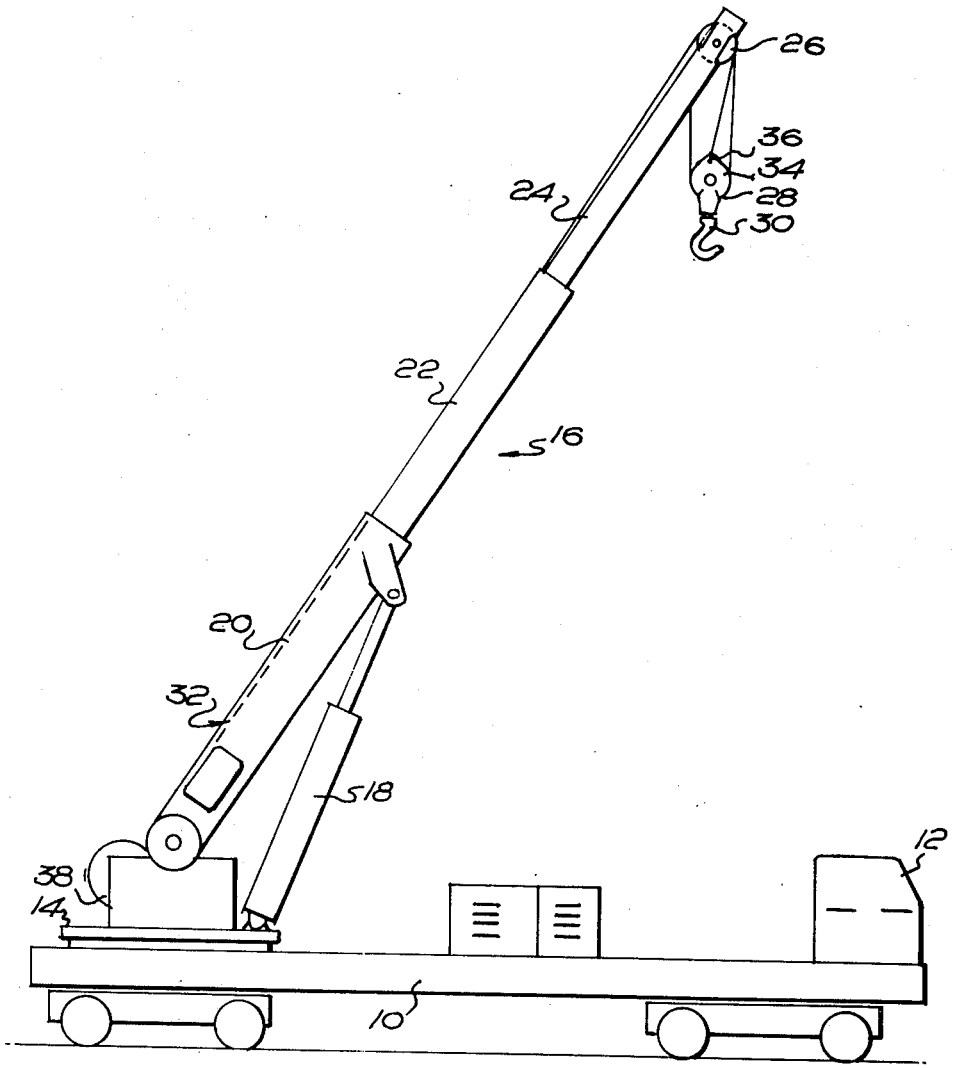
FIG. 1 is a side view of a typical mobile crane.

Referring now to FIG. 1 of the drawings, there is illustrated a mobile crane with a chassis 10 on which is mounted a drivers cab 12 and a turntable 14. An extensible boom generally indicated 16 is mounted on the turntable and its elevation about its point of pivotal connection to the turntable can be varied by means of a hydraulic ram 18. The extensible boom, the length of which can be varied in a telescopic manner, comprises an innermost section 20, an intermediate section 22 and an outermost section 24 which carries a rope pulley 26.

A pulley block 28 carrying a lifting hook 30 is suspended from the free end of the outermost section of the extensible boom. A lifting rope 32 encircles the rope pulley 26 and a further rope pulley 34 which is mounted in the pulley block 28. One end of said rope is fixed at 36 to the pulley block 28 whilst the other end of said rope is wound upon a power driven winding drum 38 mounted on the chassis. Controls (not shown) are provided whereby a driver within the cab can at will vary the length of the extensible boom and vary its elevation to adjust the working radius. Further controls (not shown) are provided for driving the winding drum to raise or lower a load suspended from the lifting hook and for rotating the turntable. The crane is provided with a safety device for indicating the approach to a dangerous working condition, that is to say, an overturning condition. The safety device includes means for sensing the working radius of the boom, means for sensing the load carried by the boom, and means for relating said load to the maximum allowable safe working load at that particular working radius.

Figure 2:
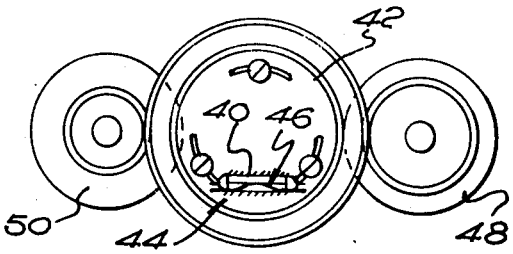
FIG. 2 is a view of part of a safety device therefor.

The means for sensing the working radius of the boom are constituted by means responsive to changes in the elevation of the boom and means responsive to changes in the length of the boom. The means responsive to changes in the elevation of the boom are illustrated in FIG. 2 and include a mercury switch 40 mounted on a disc 42 forming part of a unit (which will be referred to again presently) carried by the innermost section of the extensible boom. The mercury switch is provided with electric terminals 44 and 46 at its opposite ends the closure of which, by the volume of mercury within the switch, in response to a movement of said boom, causes a forward or reverse rotation of a servo-motor 48 which is geared to the disc 42 on which the switch is mounted. Thus, the switch is automatically returned to, or maintained in, true horizontal position. An electrical proportioning device 50 is also geared to the disc 42, as shown, and the arrangement is such that the electrical proportioning device produces an electric signal directly proportional to the elevation of the boom, that is to say, the true elevation irrespective of the slope of the ground on which the crane is standing.

The means responsive to changes in the length of the boom on the other hand are constituted by a cable reeling drum 52 mounted for rotation on the innermost section 20 of the crane boom, a length of cable 54 being wound upon the drum and extending to an outermost end of the extensible boom where it is secured at 56. A spring (not shown) acts within the drum in the opposite sense to said cable and is arranged to take up slack in said cable as the boom is shortened. The arrangement is such that any linear extension or retraction of the boom results in rotation of the cable reeling drum and this rotation is transmitted by way of reduction gearing (not shown) to an electrical proportioning device. Thus, there is produced by the device an electrical signal directly proportional to the effective length of the boom.

The electrical signal which is directly proportional to the effective length of the boom is fed into an electric circuit to which is also fed the electric signal proportional to the elevation of the boom. The circuit is such that a single electric output signal is produced and is directly proportional to the working radius of the boom.

The means for sensing the load carried by the boom, that is to say, suspended from the hook 30, are illustrated in FIGS. 4 and 5 and operate by sensing the tension in the lifting rope 32. (The load carried by the boom is of course directly proportional to the tension in the lifting rope but is dependent on the number of rope sheaves employed.) These means are constituted by an electronic rope dynamometer including an electronic load cell 60 and three freely rotatable pulley wheels 62, 64 and 66 mounted between a pair of plates 68. The pulley wheels are arranged so that the lifting rope is deflected slightly by the pulley wheel 64, and the reaction of the rope against said pulley wheel (which is of course directly proportional to the tension in the rope) is taken by the load cell. Thus, the load cell produces an electric signal which is directly proportional to the load carried by the boom.

Figure 9:
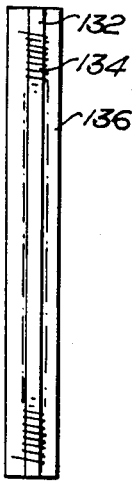
Figure 8:
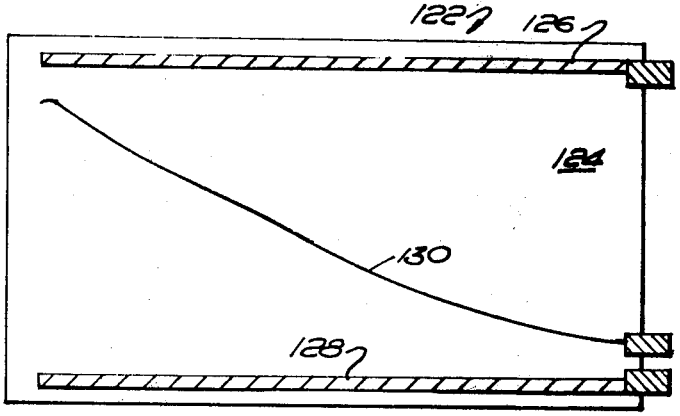

Referring now to FIS. 8 FIGS. 9, alternative and means for relating the load carried by the boom to the maximum allowable safe working load at that particular working radius include a printed circuit board generally indicated 122 and comprising a non-conductive lamina 124 with conductors 126 and 128 extending in parallel along its upper and lower edges. A metallic line 130 is also presented just proud of the surface of the non-conductive lamina, said line being a copy of the safe load/radius curve (for a particular working condition) supplied by the crane manufacturer. These means also include a resistance element including an insulation rod 132 (see FIG. 9) on which have been wound several thousand turns of resistance wire 134, the rod then having been bonded to a strip of insulation material 136 for support.

In use, a voltage is applied across the conductors 126 and 128 and the resistance element is caused to move across the printed circuit board in contact with said conductors and the metallic line 130, the relative movement between the resistance element and the circuit board being brought about in response to changes in the working radius of the lifting hook and being directly proportional to such changes. The device thus acts as a potential divider and the output potential will be proportionate to the curve of the metallic line 130. The output signal can of course be fed as reference voltage into an electric circuit as in FIG. *7a*, together with an electric signal proportional to the actual load carried by the lifting hook as the input voltage in the circuit of FIG. *7a*, and a signal can be received to indicate whether said actual load is less than or greater than the maximum safe load at that particular working radius and working condition.

Referring now to FIG. 9, other alternative means for relating the load carried by the boom to the maximum allowable safe working load at that particular working radius include an inductive device comprising a printed circuit board generally indicated 138 and having a nonconductive lamina 140 with a metallic line 142 presented just proud of its surface said line being a copy of the save load/radius curve (for a particular working condition) supplied by the crane manufacturer. These means also include a rod 144 acting as a transformer core on which primary windings 148 are wound to produce a simple transformer. As in the previous case, the rod has been bonded to a strip of insulation material 150 for support. An A.C. electrical supply is connected to the primary windings and the opposite ends of the secondary windings are bridged by a load resistor 152.

In use, the secondary winding 148 is caused to move across the printed circuit board in contact with the metallic line 142, the relative movement between the secondary winding and the circuit board being brought about in response to changes in the working radius of the lifting hook and being directly proportional to such changes. An output voltage is taken from a contact 154 at one end of the metallic line 142 and from a lead 156 connected at one end of the secondary winding. As in the previously described example, the ouput signal can be fed into the electric circuit referred to, together with an electric signal proportional to the actual load carried by the lifting hook. The circuit is such that it gives a signal to indicate directly whether the actual load is less than or greater than the maximum safe load at that particular working radius and working condition.

Figure 10:
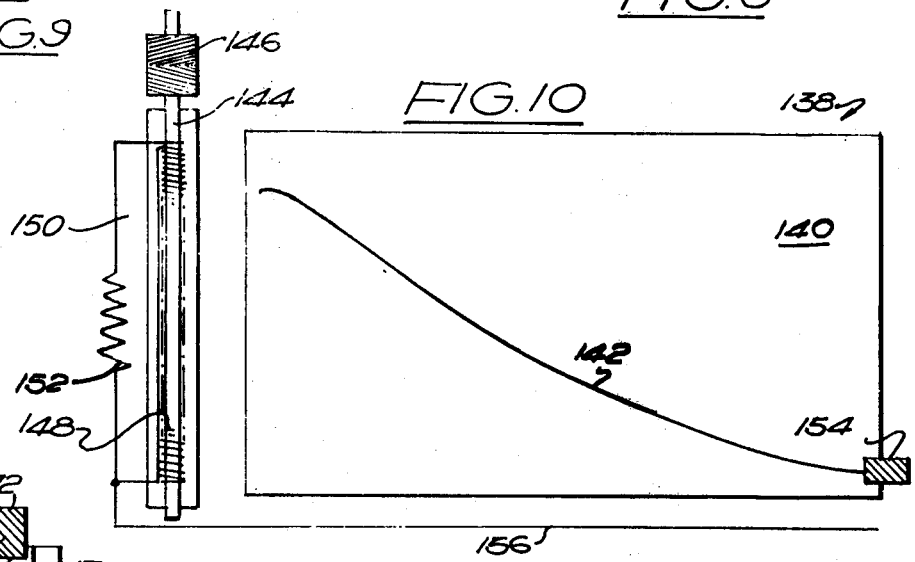
Figure 12:
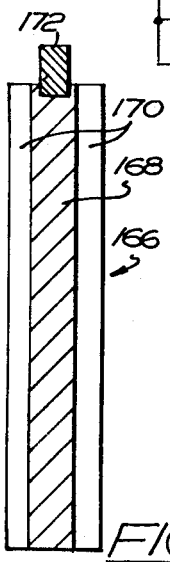
Figure 11:
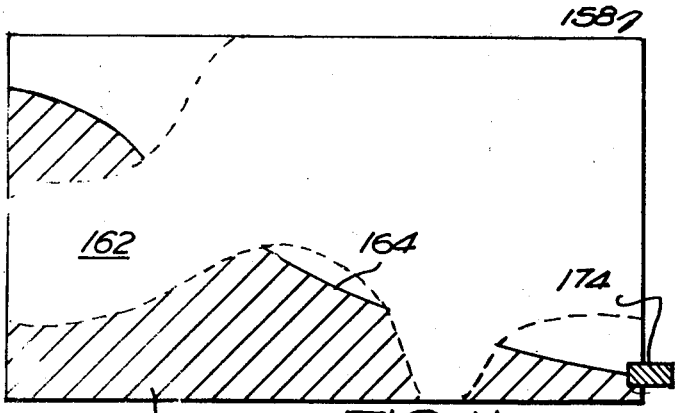

Referring now to FIGS. 10 and 11, a still further possible alternative to the originally described means for relating the load carried by the boom to the maximum allowable safe working load at that particular working radius includes an electrostatic device including an electrostatic capacitance generally indicated 158 comprising alternate layers of conductive and non-conductive material (for example 160, 162) the conductive layers defining an area bounded by a curve 164 which is a copy (on any chosen scale) of the safe load/-radius curve, for a particular working condition, supplied by the crane manufacturer. The device also includes an electro-static capacitance generally indicated 166 comprising a strip of conducting material 168 flanked by strips of non-conducting material 170.

In use, the capacitance 166 is caused to move across the face of the capacitance 158, the relative movement being brought about in response to changes in the working radius of the lifting hook and being directly proportional to such changes. Consequently, the area of the conductive material of each layer 160 of the capacitance 158 covered by the capacitance 166 varies according to the working radius of the lifting hook and if an alternating current is connected to contacts 172 and 174 the current will change according to the working radius due to the capacitance variation. As in the case of each example described above, this changing current can be used by a normally skilled electronics engineer, together with a signal proportional to the actual load carried by the lifting hook, to indicate whether the actual load is less than or greater than the maximum safe load which can be carried at that particular working radius and working condition.

It will of course be realised that there may be any number of resistive or inductive or electro-static devices as the case may be, according to the number of available combinations of working conditions. For example, when changing from an unchocked to a chocked condition, that is to say, when auxiliary support legs are brought into use, the tendency for the crane to overturn is reduced. Thus, a crane manufacturer will provide two sets of figures for maximum allowable safe working loads for these two alternative conditions. Similarly, when the number of lifting rope sheaves is varied the tension in the rope at a particular working load is varied accordingly (although of course the tension in the rope is still proportional to the working load). Here again, different resistive, inductive or electrostatic devices, as the case may be, could be provided to take account of each possible rope sheave variation although in this particular case it may well be possible to make allowance for this change of working condition by some simpler adjustment; for example, a different load cell could be brought into use or alternatively it may well be possible to proportion the electrical signal produced by the load cell according to the number of rope sheaves by the use of fixed electrical resistances which may be switched into circuit selectively. Indeed this kind of arrangement may be employed to vary the strength of electrical signals by known percentages to changing working conditions. For example, if it is known that safe maximum working loads over the rear of a crane are, say, 20% less than the safe maximum working loads which can be lifted over the front, a common resistive, inductive or electro-static device, as the case may be, may be employed with an appropriate fixed electrical resistance which can be switched into or out of circuit selectively.

Various other modifications may be made without departing from the scope of the invention. For example, an electrical signal proportional to the maximum allowable safe working load at the radius at which the lifting hook is working could be produced by other means. Furthermore, in either of the devices illustrated in FIGS. 8 and 10 the metallic lines on the boards may be produced by any of the methods normally employed for making printed circuit boards. They could also be formed by the simple expedient of machining a shallow groove in the board, the groove having the shape of the required curve, and laying a metallic rod in the groove (for example a length of brasing rod) so that it stands proud of the board.

It will of course be understood that there are a very great number of combinations of possible working conditions. For example, a typical crane having an extensible boom may have three sets of figures for maximum allowable safe working load to cover a full rotation of the boom. These sets of figures will be duplicated to cover chocked and unchocked conditions and may be multiplied again by four if there are four possible rope reeve variations. Thus in this instance there are twenty four possible combinations of working condition. These may well be catered for by 24 separate resistive, inductive or elecro-static devices, as the case may be, or more conveniently by twenty four separate mechanisms, which can be switched into use selectively, although by appropriate design of the electric circuit it may be arranged for a single proportioning device to be used in combination with means for varying its output electronically, that is to say, by a selected one of a number of fixed electrical resistances being switched into circuit.

What we claim and desire to secure by Letters Patent is:

1. In a safety device for a jib crane of variable working radius having a jib from a free end of which depends a lifting hook, comprising means for sensing the magnitude of a load carried by the lifting hook; means for emitting a first electrical signal proportional to said load; means for sensing the working radius of the lifting hook; means for emitting a second electrical signal proportional to the maximum allowable safe working load at that particular working radius; and means for continuously relating said first electrical signal to said second electrical signal; the improvement in which said means for emitting a second electrical signal comprises a circuit board comprising a non-conductive lamina with conductors extending in parallel spaced relation along the surface of said lamina, a curved metallic line extending along and protruding from said surface between said conductors, and an insulating rod wound with a multiplicity of turns of resistance wire, said rod being perpendicular to said conductors and movable along said conductors with said turns of wire in contact with said conductors and with said metallic line, whereby when voltage is applied across said conductors, movement of said insulating rod along said conductors in proportion to changes in said working radius produces an output voltage which is proportional to the curve of said metallic line and which constitutes said second electrical signal.

* * * * *